US009418495B2

(12) United States Patent
Mackin et al.

(10) Patent No.: US 9,418,495 B2
(45) Date of Patent: Aug. 16, 2016

(54) ELECTRONIC LOCK APPARATUS, METHOD AND SYSTEM

(71) Applicant: PARCELHOME LIMITED, Dublin (IE)

(72) Inventors: Gregory Mackin, Londres (GB); Jean-Michel Huten, Jullouville (FR); Julien Vassallo, Paris (FR)

(73) Assignee: PARCELHOME LIMITED, Dublin (IE)

( * ) Notice: Subject to any disclaimer, the term of this patent is extended or adjusted under 35 U.S.C. 154(b) by 28 days.

(21) Appl. No.: 14/598,008

(22) Filed: Jan. 15, 2015

(65) Prior Publication Data

US 2015/0199857 A1 Jul. 16, 2015

(30) Foreign Application Priority Data

Jan. 16, 2014 (GB) ..... 1400741.3

(51) Int. Cl.
*E05B 45/06* (2006.01)
*G07C 9/00* (2006.01)

(52) U.S. Cl.
CPC ..... *G07C 9/00023* (2013.01); *G07C 9/00174* (2013.01); *G07C 9/00896* (2013.01); *G07C 2009/0023* (2013.01); *G07C 2209/06* (2013.01); *G07C 2209/08* (2013.01)

(58) Field of Classification Search
CPC ..... G07C 9/00023; G07C 9/00896; G07C 2209/08; G07C 9/00182; G07C 9/00174
USPC ..... 713/155, 158, 183, 401, 501, 502, 601
See application file for complete search history.

(56) References Cited

U.S. PATENT DOCUMENTS 4,334,314 A * 6/1982 Nard ..... G01S 5/14 375/362
4,599,489 A * 7/1986 Cargile ..... G06F 21/34 705/52
4,885,778 A * 12/1989 Weiss ..... G06F 7/582 235/382
7,069,451 B1 * 6/2006 Ginter ..... H04N 21/8358 348/E5.006
7,657,531 B2 * 2/2010 Bisbee ..... G06F 21/33 707/783
7,831,854 B2 * 11/2010 Lai ..... G06F 13/4291 711/103
8,306,227 B2 * 11/2012 Tsunoo ..... G06F 12/0862 380/201
8,797,138 B2 * 8/2014 Myers ..... G07C 9/00571 340/5.7
2003/0179075 A1 * 9/2003 Greenman ..... E05B 19/0005 340/5.54
2003/0231102 A1 * 12/2003 Fisher ..... G07C 9/00103 340/5.73
2004/0034771 A1 * 2/2004 Edgett ..... G06F 21/31 713/168
2006/0152339 A1 * 7/2006 Mercier ..... G07G 1/0054 340/5.73
2006/0176870 A1 * 8/2006 Joshi ..... H04W 88/06 370/345
2006/0196926 A1 * 9/2006 Benson ..... G07F 17/12 235/375
2007/0181662 A1 * 8/2007 Satherblom ..... A47G 29/1207 232/45
2009/0222359 A1 * 9/2009 Henry ..... G06Q 10/087 705/28
2013/0043973 A1 * 2/2013 Greisen ..... G07C 9/00571 340/5.51
2014/0068247 A1 * 3/2014 Davis ..... B60R 25/24 713/155

FOREIGN PATENT DOCUMENTS

EP 0234100 A2 9/1987
GB 2372126 A 8/2002
WO 2013090211 A2 6/2013

* cited by examiner

*Primary Examiner* — Hai Phan
*Assistant Examiner* — Son M Tang
(74) *Attorney, Agent, or Firm* — Dentons US LLP

(57) ABSTRACT

A locking device comprising: a code generation means for generating a plurality of access codes in a first series and a second series, each access code being valid for a predetermined period of time, a code input means for receiving an input code, and a code comparison means, wherein the code comparison means is configured to unlock the lock in response to input of a code that corresponds to a currently valid access code, wherein the period of validity of each access code in first series partially overlaps the period of validity two adjacent access codes in the second series.

10 Claims, 12 Drawing Sheets

ELECTRONIC LOCK APPARATUS, METHOD AND SYSTEM

This application claims the benefit of the United Kingdom Patent Application No. 1400741.3, filed on Jan. 16, 2014, which is hereby incorporated by reference for all purposes as if fully set forth herein.

BACKGROUND

1. Technical Field

The present invention relates to electronically-activated locks. In particular, such locks are suitable for locking access doors, more particularly still the locks are suitable for locking access door on containers, such as containers for holding packages that are delivered or collected in the absence of the recipient. The invention also relates to associated methods for locking and unlocking such locks, a server for processing requests to unlock such locks and a system for locking and unlocking the locks.

2. Related Art

Receiving goods via home or small office delivery is becoming increasingly common with the advent of online shopping. However, such deliveries are typically made during normal working hours, therefore if the recipient if not normally at home during such times, a problem exists in that there will be no one available to receive the goods. Moreover if goods need to be collected, for example to return them to a vendor, then a similar problem exists in the absence of the sender.

Typically, in such circumstances a delivery person will usually opt to deliver the goods to a neighbour, leave the goods in an unsecured location or simply not deliver. None of these solutions is ideal from the point of view of either the deliverer or the recipient. If the goods are delivered to a neighbour the recipient must then find the neighbour whilst they are in, in order to actually receive the goods. If the goods are left in an unsecured location, then there exists the possibility that the goods will be stolen or damaged before the recipient retrieves them. If the goods are not delivered then typically, the recipient will have to arrange to collect the goods at a suitable time. Throughout this application, the term goods and package are used interchangeably, and are intended to cover an item that is left as a delivery or for later collection.

Solutions to this problem exist in the form of secure delivery boxes that are located, for example, at railway stations. The delivery person can then leave the goods in a secure box, and the recipient can be supplied with a code or key to open the box. This lacks the convenience of delivery to the recipient's home, and if the goods are heavy or bulky it may be difficult to then transport them back home.

Secure delivery boxes for the home also exist, and typically take two general forms. Either the box has some form of delivery chute to allow a delivery person to deposit goods in the box but not to remove goods from the box, or alternatively the box contains some form of electronic lock to allow a delivery person to open the box using a code and deposit the goods.

Boxes with delivery chutes typically must be very large to allow large packages to be delivered since typically the chute must be of comparable size to the box. In addition, if the box is already full then delivery of a further package will not be possible. Further no delivery tracking is usually possible. Moreover, such boxes cannot be used to store packages for collection since the person collecting the package has no access to the box.

Boxes with electronic locks have the problem that access codes must be changed periodically to prevent undesired access to the box. Without a connection to a computer network, the changing of the codes must be done whilst the user is at home, and also knowledge of the status of the box (e.g. full or empty) or of the access history (who opened the box and at what time) will not generally be known. Typically, it is costly and difficult to provide such a connection to a delivery box, and in addition such a connection will usually also require the provision of an external source of power. Moreover, both types of box do not permit a "signed for" delivery or collection, and so a delivery that requires such a signature cannot be made.

It is an aim of the present invention to solve or mitigate at least some of the above-described problems.

SUMMARY

In a first aspect, there is provided a locking device comprising: a code generation means for generating a plurality of access codes in a first series and a second series, each access code being valid for a predetermined period of time, a code input means for receiving an input code, and a code comparison means, wherein the code comparison means is configured to unlock the lock in response to input of a code that corresponds to a currently valid access code, wherein the period of validity of each access code in first series partially overlaps the period of validity two adjacent access codes in the second series Thus, advantageously, the locking device can accept a plurality of input codes at any given time as valid codes, and thereby allowance can be made of any errors in the timing used to calculate the input codes.

In some embodiments, the period of validity of each access code in each series is equal and the overlap of the period of validity of each access code in the series is equal to half of the period of validity.

In some embodiments, access codes are generated in a third series and the period of validity of each access code in the second series partially overlaps the period of validity of two adjacent access codes in the third series. Thus, in such embodiments more access codes are valid at any given time, and more allowance can be made for any errors in the timing used to calculate the input codes.

In some embodiments, the code generation means further comprises an electronic timer and means to compare a time at which an input code, that corresponds to a currently valid access code, is input with the elapsed fraction of the validity period of the currently valid access code. Thus, advantageously, the locking device can derive information about whether the electronic timer means is properly synchronised with a timer means on a server that is used to provide the code input.

In some embodiments, the code generation means is further configured to adjust the current time of the electronic timer on the basis of the elapsed fraction of the validity period of the currently valid access code. Thus, advantageously, the synchronisation between electronic timers in the locking means and the device used to provide the input codes can be improved.

In some embodiments, the adjustment of the current time of the electronic timer acts to move the current time forward if the comparison reveals that a valid access code is input towards the end of its validity period, and move the current time backward if the comparison reveals that a valid access is input towards the beginning of its validity period.

In some embodiments, the adjustment is made on a statistical basis by using the input time of a plurality of valid input codes with respect to their respective validity periods. Thus, advantageously, the synchronisation of timers can be improved by using information from more than one input code.

In some embodiments, a plurality of sets of series of access codes are generated concurrently, each of the sets of series of access codes being associated with a different class of user of the locking device. Thus, advantageously, the response of the locking device can be tailored to suit the particular class of user.

In a second aspect, there is provided a container for receiving deliveries, or storing packages prior to collection, comprising the locking device according to the first aspect.

In a third aspect, there is provided a method of operating a locking device, the method comprising: generating a plurality of access codes in a first series and a second series, each access code being valid for a predetermined period of time, receiving an input code, and unlocking the lock if the input code corresponds to a currently valid access code, wherein the period of validity of each access code in the first series overlaps the period of validity of two adjacent access code in the second series.

In a fourth aspect, there is provided a method of providing access codes from a server device, the method comprising: receiving, at a server, a request for provision of an access code, the request comprising an identifier related to a locking device and an identifier related to a user making the request, determining, on the basis of the identifier of the locking device and the identifier of the user, whether the request is valid and, if the request is valid, providing an access code for opening the locking device, wherein the provided access code is determined on the basis of the time at which the code is generated.

In some embodiments, the provided access code is dependent on the identifier of the user.

In further aspects there is provided a computer program product comprising computer readable instructions which, when implemented on a processor perform all of the steps of the method of any of the third or fourth aspects, and a computer readable medium comprising such a computer program.

BRIEF DESCRIPTION OF THE DRAWINGS

The invention will now be described with reference to the accompanying Figures of which.

DETAILED DESCRIPTION

Figure 1:
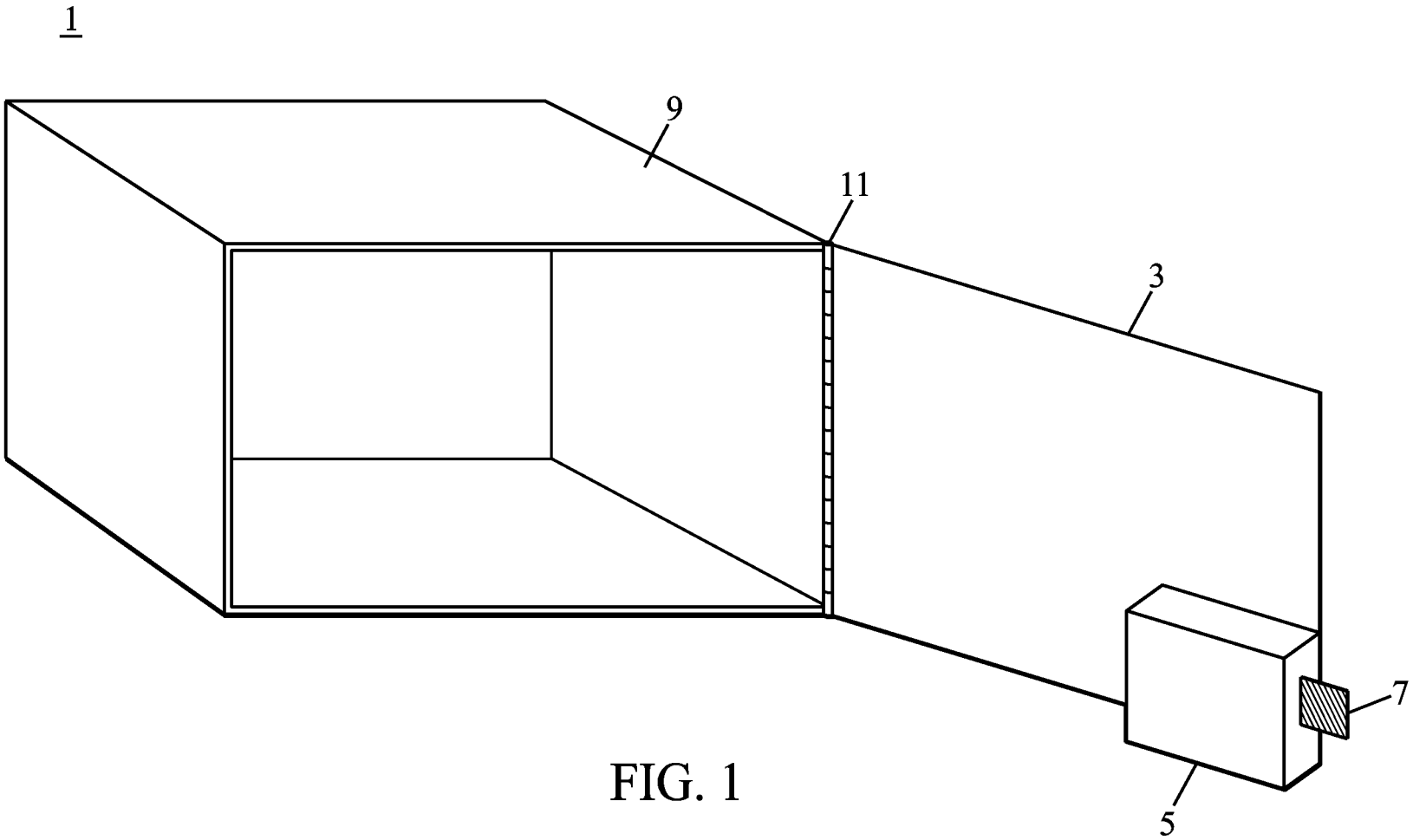
FIG. 1 illustrates a box for receiving deliveries in accordance with an embodiment of the invention.

FIG. 1 illustrates an example of a delivery/storage box 1 to which a lock 5 according to an embodiment of the present invention can be attached. Whilst embodiments of the invention are described herein in the form of such boxes, the skilled reader will understand that locks according to the invention can equally be implemented in other similar situations, such as locks for securing doors to the home, office or other premises and locks for safes, lockers or vaults.

The box 1 of FIG. 1 comprises a container 9 that is in the form of a rectangular box with one side that is operable to be opened by means of a door panel 3. The door panel 3 is hinged 11 along one edge to allow the door panel 3 to open and close. The box 1 can, for example, be fixed to the wall of a house via fixing means internal to the box 1, so as to form a secure box for home delivery of packages that cannot be moved from a fixed location without having access to the inside of the box 1. A lock 5 is provided on the door panel 3, the lock 5 has a locking means 7 which, when in its locked state, is configured to prevent the door panel 3 from being opened. Thus, a package can be placed inside the box 1 and, when the door panel 3 is locked shut, access to the package is restricted.

The skilled person will recognise that the box 1 can be of essentially any size and shape, and that configurations other than that illustrated can equally be employed. Thus, for example, the lock 5 can be located in places other than on the door panel 3 of the box 1, such as on a side wall of the box 1. Moreover, the locking means 7 can be provided in a manner that is physically separate from the rest of the lock 5. The skilled person will also understand how to implement a locking means 7 in such a box and so further details will not be explained here.

Figure 2:
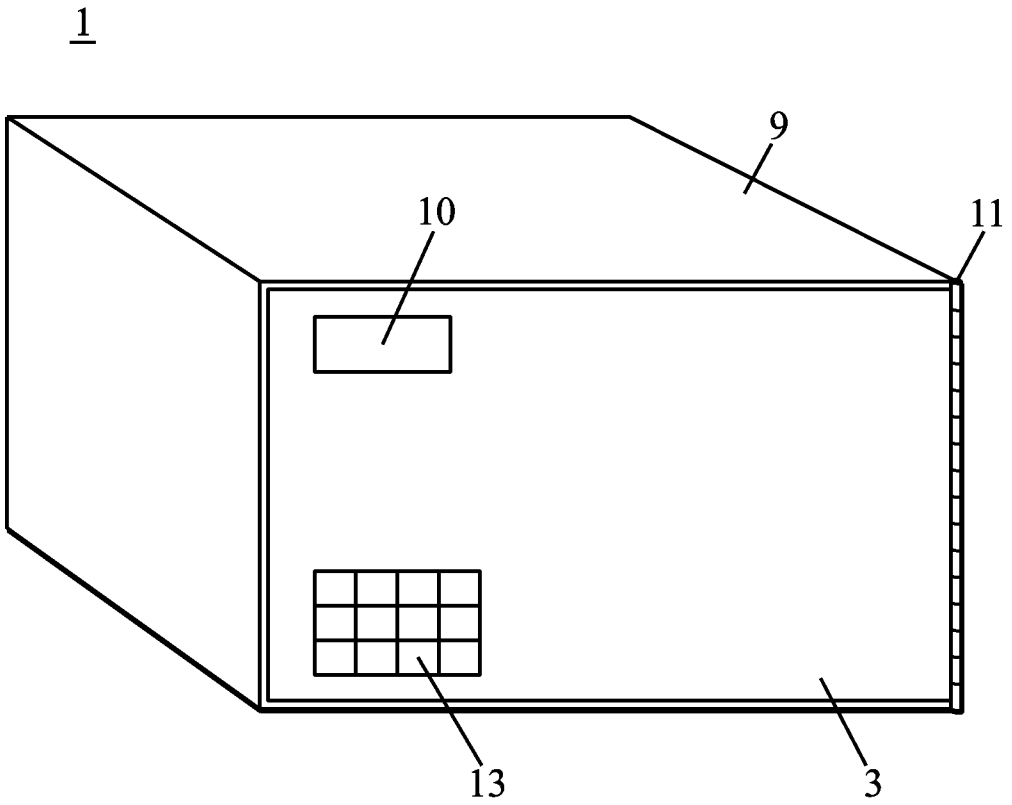
FIG. 2 illustrates further details of the box of FIG. 1.

FIG. 2 illustrates the box 1 of FIG. 1 when the door panel 3 is in its closed state. As illustrated in FIG. 2, on the outside of the door panel 3 is a keypad 13. The keypad 13 is configured to allow input of a code wherein input of a suitable access code will cause the lock 5 to open and allow access to the box 1. The skilled person will recognise that the keypad can be located at other points on the outside of the box 1, or indeed in a separate location to that of the box 1.

In alternative embodiments no keypad is provided and input of an access code can be effected by means of wireless communications such as near field communications (NFC), Bluetooth, IEEE 802.11 or the like. In further alternative embodiments both a physical keypad 13 and access via wireless means are configured to be possible on the box 1.

Also shown in FIG. 2 is a box identifier 10. The box identifier 10 comprises information that provides a unique identifier for the box 1. In the presently described embodiment, the box identifier 10 comprises a code on the outside of the box, such as an alphanumeric code, barcode, data matrix or the like. As illustrated in FIG. 2, the box identifier 10 is visible on the outside of the box 1. However, in alternative embodiments, the box identifier 10 can be invisible from the outside of the box 1, and instead take the form of information merely associated with the box, for example stored in a memory inside the box 1.

Figure 3:
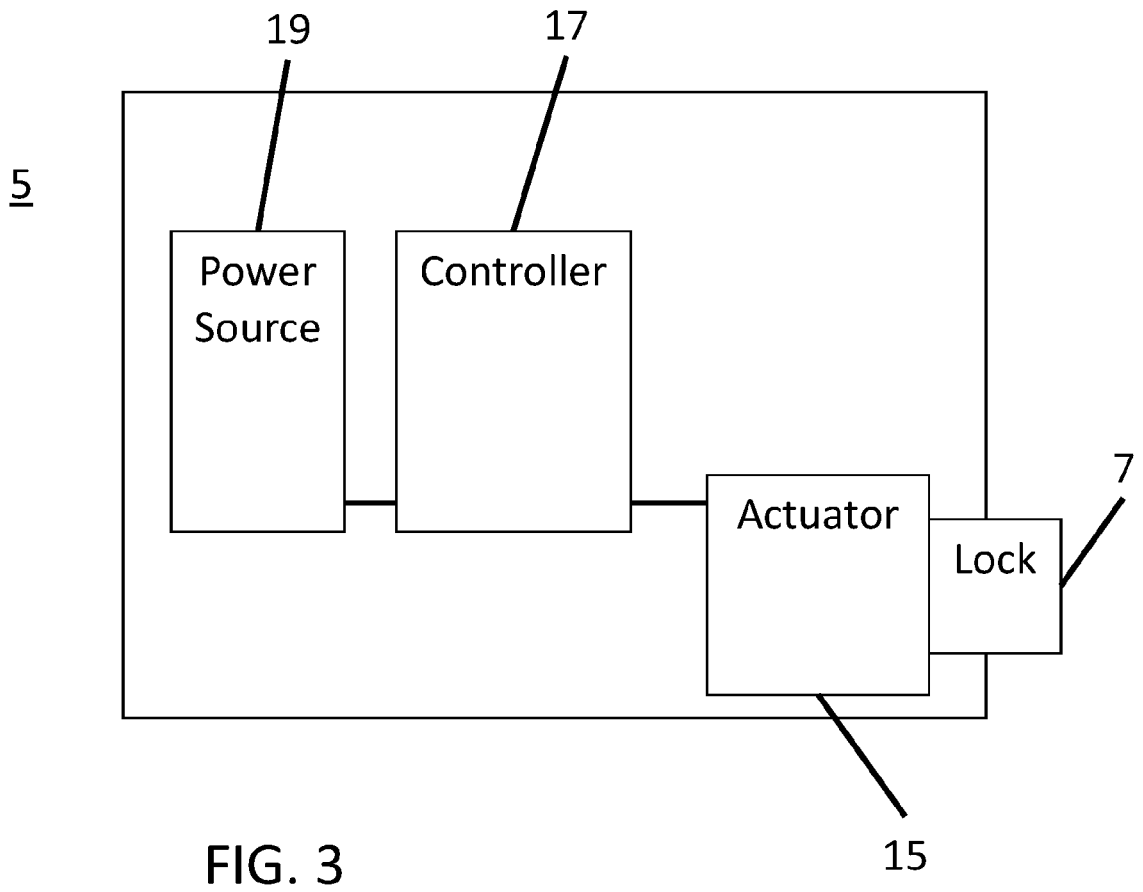
FIG. 3 illustrates details of a lock for the box of FIGS. 1 and 2.

FIG. 3 illustrates further details of the lock 5 according to an embodiment of the invention. The lock 5 comprises a locking means 7 in the form of a bolt, and an actuation means 15. The actuation means 15 is configured to mechanically operate the locking means 7 to lock or unlock the locking means 7 in response to an electronic signal. The electronic signal is provided by a controller 17, further details of which will be described below. The lock 5 also has a power source 19, in this example embodiment, the power source 19 is a battery.

However, in alternative embodiments the power source 19 can comprise other sources of electrical power such as a connection to mains power, a capacitor, a fuel cell, a photovoltaic cell or a combination of such sources, such as mains power with a battery back up.

In operation, the controller 17 and actuator means 15 are powered by the power source 19. To open the lock 5, a valid access code must be input, either via the keypad 13 or other code input means as described above. Upon receipt of a valid access code, the controller 17 will send an electronic signal to the actuator means 15 to open the locking means 7. The skilled person will recognise that the process of locking the lock 5 after opening can, for example, be implemented either automatically, for example at a predetermined interval after unlocking, by entering a locking code, or by mechanical actuation means.

Figure 4:
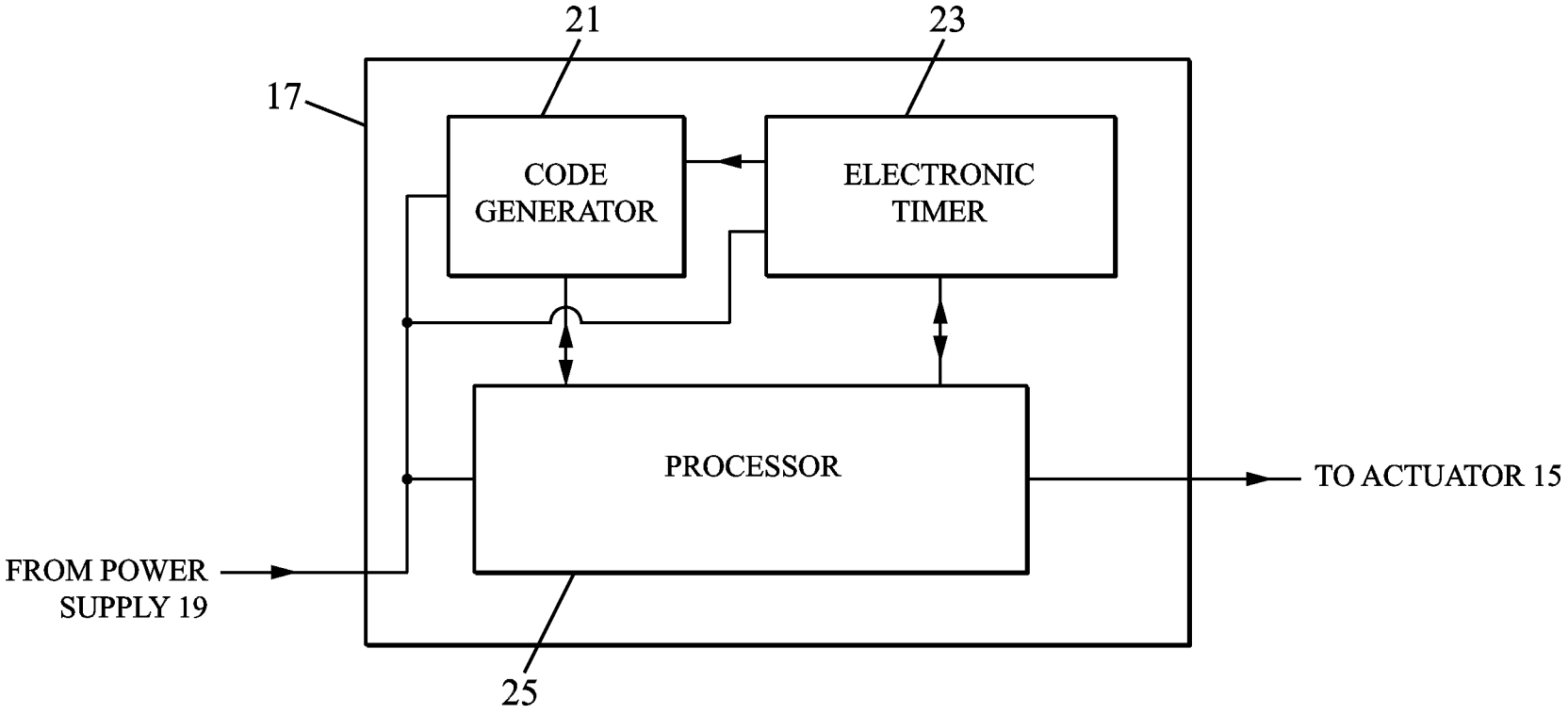
FIG. 4 illustrates further details of the lock of FIG. 3.

FIG. 4 illustrates further details of the controller 17. The controller 17 comprises a code generator 21, an electronic timer 23 and a processor 25 including a memory. The code generator 21 generates access codes that are valid for unlocking the box 1 in the manner described above. To generate access codes, the code generator 21 applies an algorithm that has inputs including a current time value, as provided by the electronic timer 23 and a seed code related to the box identifier 10. The seed code is stored in a memory device associated with the code generator 21. The algorithm used to generate the access codes can, for example, employ a hash function and/or RSA encryption to the combination of the inputs. In the case of RSA encryption, a system of public and private keys will be employed for transmission of the access codes. The skilled person will recognise how to implement such a system and so further details will not be provided here.

Since the algorithm as described above is used to generate the access code, the resulting access code cannot easily be replicated by means external to the box 1 without knowledge of the time, the seed code and the actual algorithm employed. In the presently described embodiment, whilst the seed code is related to the box identifier 10, it is kept secret and will typically be known only to a service provider providing services related to the box 1. Typically, each box 1 will have a unique seed code. In the presently described embodiment, the access codes each comprise a six digit number. However, the skilled person will recognise that access codes having a higher or lower number of digits can equally be used. In addition, access codes comprising characters other than numbers can also be employed. Thus access codes can comprise any character/number/symbol so long as such a symbol can be input via a code input means.

The code generator 21 is configured to generate a new access code at periodic intervals. In the presently described embodiment, the interval is two minutes, although the skilled person will recognise that other intervals could equally be used. Thus, every two minutes, the electronic timer 23 sends a new current time value to the code generator 21, and this triggers the code generator 21 to apply the code generation algorithm again, taking its inputs as the seed code and the new current time value.

Upon generation of a new access code, the previously generated access code becomes invalid. Thus, effectively, the access code required to open the lock 5 changes every two minutes. Accordingly, to access the box 1, a user must have knowledge of the currently valid access code.

The processor 25 is configured to receive and store the currently valid access code from the code generator 21 and also to receive input codes input by a user. As noted above, these input codes are either input via a keypad 13 or via the other possible input means described. The processor 25 then compares an input code with the currently valid access code. If these codes match, then the processor 25 sends an appropriate signal to the actuator 15 to open the lock 7.

If the comparison of the input code and the currently valid access code reveals that these codes do not match, then no unlock signal is sent to the actuator 15. Moreover, the processor 25 records the fact that an incorrect code has been input. In the presently described embodiment, the processor 25 is configured to permit three incorrect input code attempts to be made before entering a state wherein further attempts at inputting a code are not accepted for a period, i.e. users are 'locked-out'. This period is, for example, five minutes. Thus, unauthorised access to the box 1 by trying a large number of input code possibilities is effectively prevented. The skilled person will recognise that other numbers of permitted attempts and 'lock-out' periods with a different duration can equally be employed.

Figure 5:
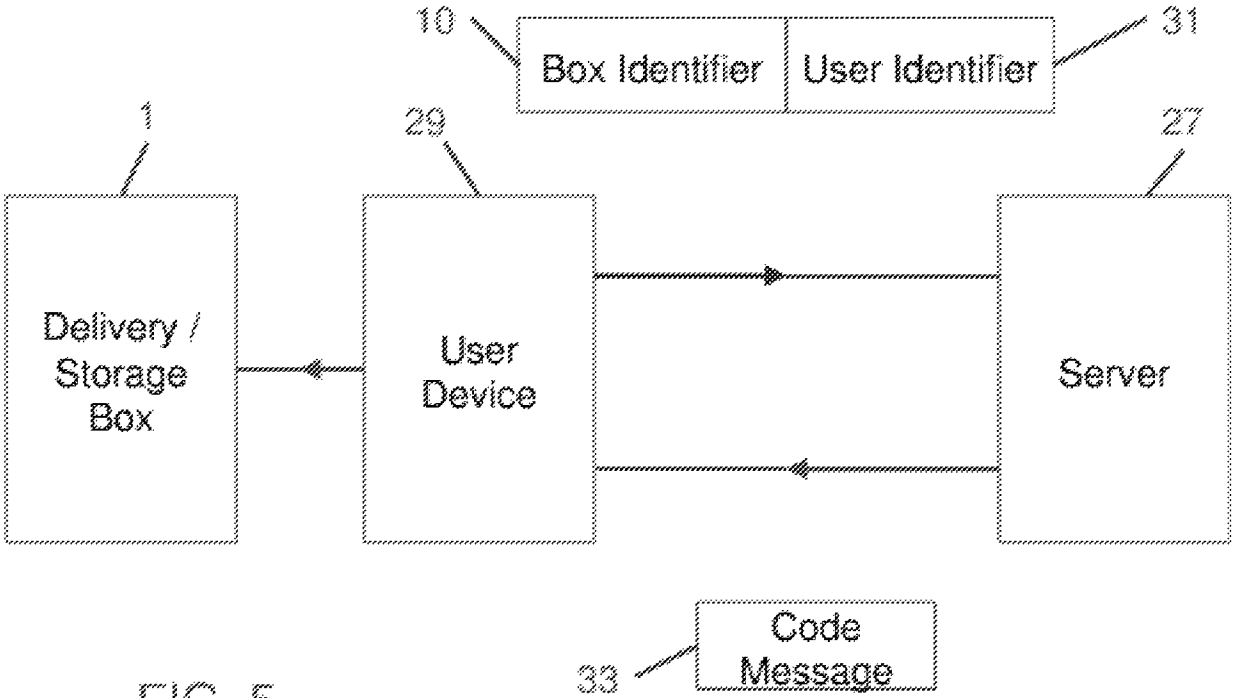
FIG. 5 illustrates details of making a request to open a lock according to embodiments of the invention.
Figure 6:
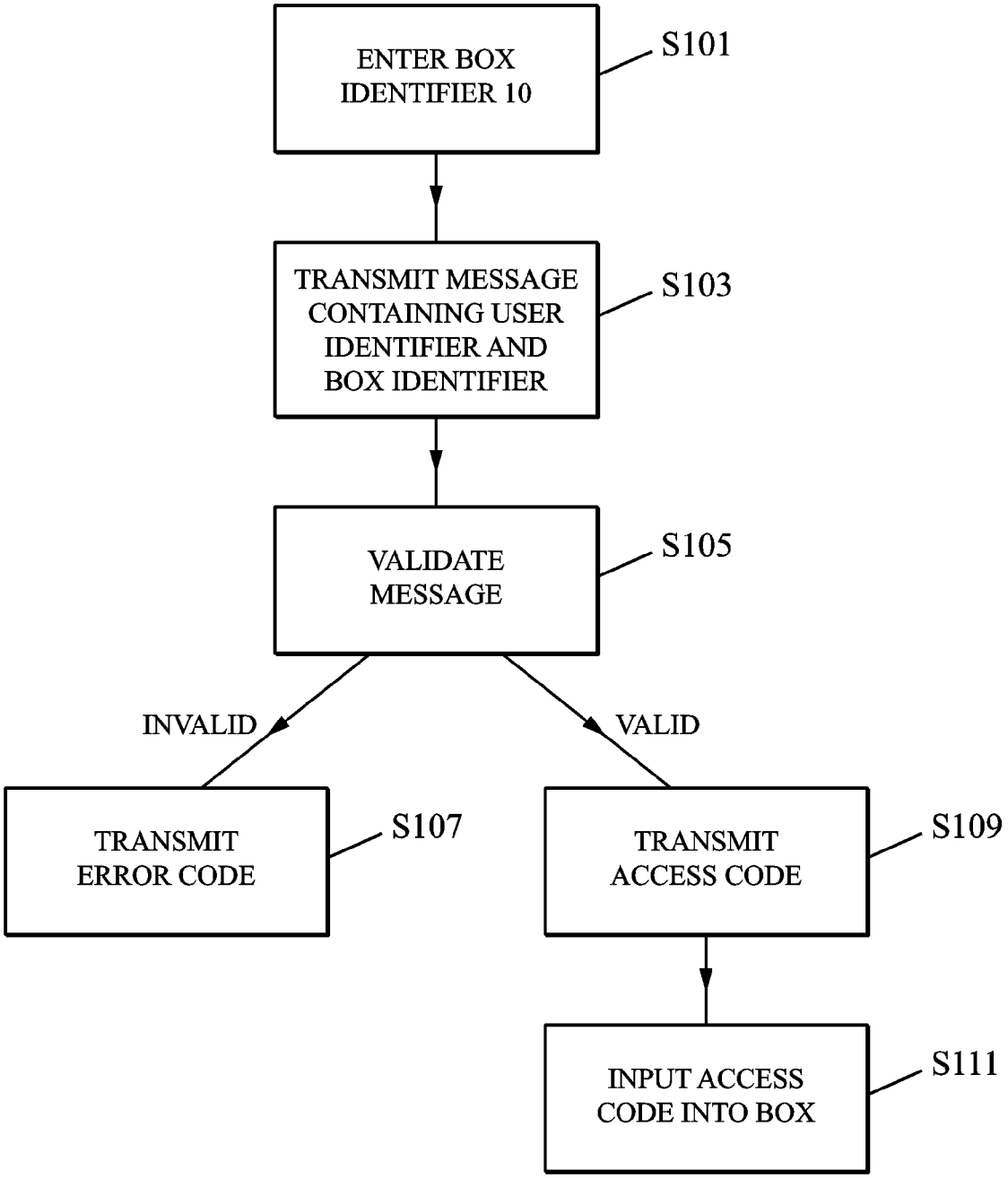
FIG. 6 illustrates steps in a method of opening a lock according to embodiments.

There now follows a description of an apparatus and method for providing access codes to a user of the box 1 with reference to FIGS. 5 and 6. Typically, the provision of access codes is effected using a remote server 27. The remote server 27 has a wireless connection with a user device 29. The user device 29 can, for example, comprise a smart phone or other mobile telephone, or a dedicated device used by a package delivery person. For the purpose of explanation, it will be assumed that the user device 29 is a smart phone.

A user device 29 for use with the present invention is assigned a user identifier 31 in the form of a unique number, this user identifier 31 can, for example, be the GUID of the user device 29, or be a number specially assigned to the user device 29 for the purpose of putting the invention into effect. The user identifier 31 is stored in a memory of the user device 29. With reference to FIG. 6, when the user of the user device 29 wishes to request an access code for a box from the server, the user enters S101 the box identifier 10 into the user device 29. In the presently described embodiment this is accomplished by manual input of the box identifier 10 into the user device 29, for example via a keypad or a virtual keypad displayed on a touch screen of the user device 29. Subsequently, a request message comprising both the box identifier 10 and the user identifier 31 is transmitted S103 to a remote server 27. The request message can, for example, take the form of an SMS or an HTTP or HTTPS request. The remote server 27 then performs a validation process S105 to validate the user identifier 10 and the device identifier 31. If the validation process S105 reveals that the combination of user device 29 and box identifier 10 is considered invalid, then the server responds S107 by transmitting a code message 33 containing an error code to the user device 29. Thus, in this instance, access to the box 1 is not possible. The error code can comprise information indicating a reason or reasons why access is not permitted.

Conversely, if the validation process S105 reveals that the combination of user device 29 and box identifier 10 is considered valid, then the server responds S107 by transmitting a code message 33, containing an access code, to the user device 29. The user can then input 5111 this access code into the keypad 13 of the box 1 to gain access to the box 1. The process of validation will be described in greater detail below in relation to FIG. 8.

In the presently described embodiment, the user uses software to facilitate the transmission and reception of the messages to and from the server. Thus, the software comprises means to store a user identifier 31, means to receive input of a box identifier 10, means to construct and transmit a message to a remote server, the message comprising the user identifier 31 and the device identifier 10 and means to receive a code message 33 from a remote server 27.

In an alternative embodiment, no dedicated software is employed on the user device 29. Rather, the user sends a short message service (SMS) message to the server to request an access code. The SMS message includes both the box identifier 10, and the user identifier. On receipt of the SMS message, the server will respond appropriately by sending an SMS message in reply, the reply message comprising a code message as per the previous embodiment.

In an alternative embodiment, the message sent to the remote server 27, from either the dedicated software or using an SMS, further comprises information related to the purpose of the access request. This information can include whether the purpose is delivery of a package, collection of a package from the box 1, a signed-for delivery or pick-up or installation/maintenance of the box 1. Further, in the event that the box 1 is shared by two or more users, the purpose information can include information as to which user the access relates.

In an alternative embodiment, the message sent to the remote server 27 can further comprise authentication means for the message. Additionally, or alternatively, the message comprising the access code or error code (as described below) sent from the server 27 to the user device 29 can comprise such authentication. The skilled person will recognise how to provide such authentication, for example using a system of public private keys, and so a further explanation will not be provided here.

In an alternative embodiment, the box identifier 10 is input into the user device 29 automatically by wireless communication with the box 1. Thus, in this embodiment, the box 1 further comprises means for wireless communication with a user device, such as an NFC device, Bluetooth device or the like. By placing the user device 29 in proximity to the box 1, transfer of the box identifier 10 can be accomplished. The skilled person will recognise that input of the access code into the box 1 can also be accomplished by this wireless means. Thus, in this embodiment, no direct user input is required to obtain access to the box 1. The remaining steps of the method can however be essentially the same as described in relation to the previous embodiments.

In a further embodiment, compatible with any of the previously described embodiments, a password must also be provided to the user device 29 before the remote server 27 will issue an access code. The password can either be validated by the user device or by the remote server 27. In the former case, the skilled person will recognise how to implement a system wherein a password is required to gain access to functions of a user device 29. Therefore further explanation will not be provided here. In the latter case, the message transmitted from the user device 29 to the remote server 27 in step S103 will further comprise a password (or data related to a password) that is input to the user device 29 by a user. Thus, the server can validate the password during the validation step S105. This embodiment has the added advantage that unauthorised use of a user device 29 can be prevented, for example in the event that the user device 29 is lost or stolen.

Figure 7:
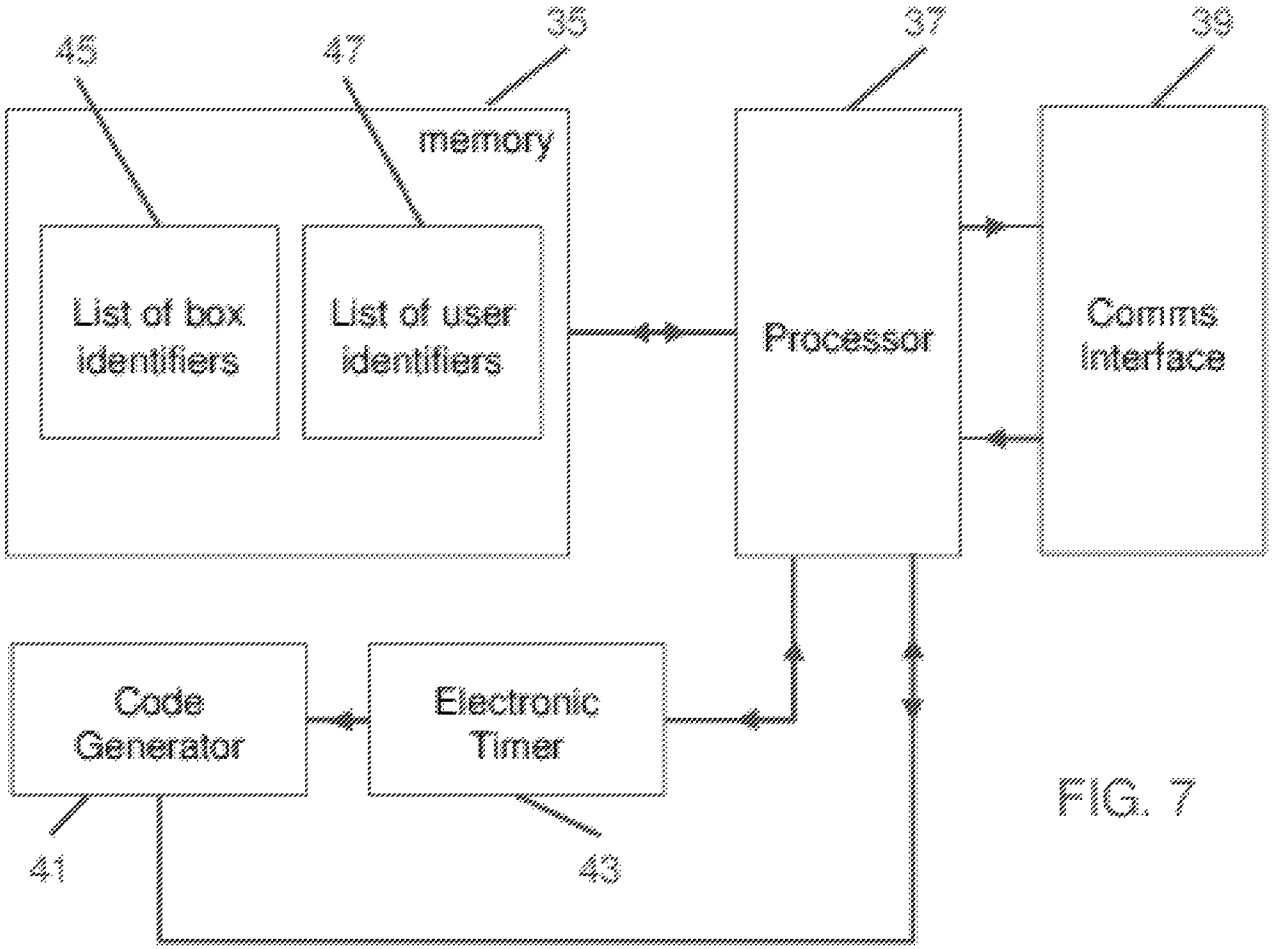
FIG. 7 illustrates details of a server according to embodiments.

The method of validation of request messages at the remote server 27 will now be described in relation to FIG. 7. As illustrated in FIG. 7, the remote server 27 includes a memory 35, a processor 37, a communications interface 39, a code generator 41 and an electronic timer 43. The term server as used herein is used to cover any computing device that is capable of providing authentication of a request and subsequent calculation of an access code via a network connection. Moreover, whilst the description of the embodiments provides details of communication directly with a remote server 27, it is specifically envisaged that other computing devices may also be included within a network in which the user device 29 and the remote server 27 exist. Such other computing devices could, for example, be used to provide authentication of the user device to the server and vice versa.

The memory 35 contains details of each box registered to the remote server 27 and each user identifier 31 registered. These details can, for example, be stored in the form of one or more look-up tables (LUTs).

For each box 1, the box identifier 10 is stored and is associated with stored a seed code in a box list 45. The stored seed code can be the same seed code that is stored in the code generator 21 of the box 1. However, this is not necessarily the case, and the seed code can also be a seed code that is merely related to the seed code in the box 1. For each box 1, the memory 35 also stores a list of user identifiers 31 that are registered for access to the particular box 1. In addition the memory 35 further comprises a list 47 of user identifiers 31 that are registered to delivery firms.

Figure 8:
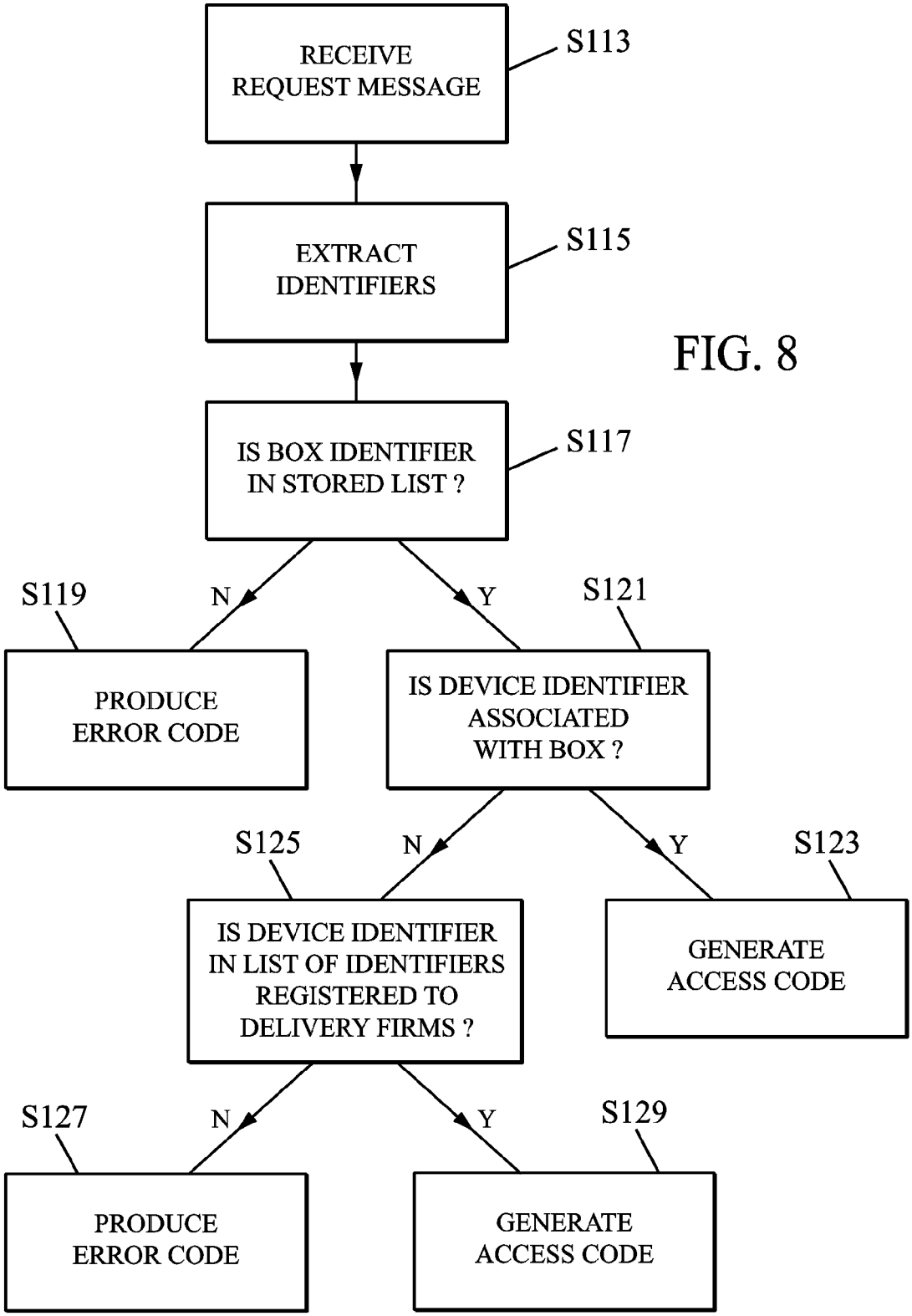
FIG. 8 illustrates steps in a method of processing access requests at a server according to embodiments.

Thus, the steps with the validation process S105 will now be described with reference to FIG. 8. In step S113 the communications interface 39 receives a request message comprising the box identifier 10 and the device identifier 31. In step S115, these identifiers 10, 31 are extracted from the message by the processor 37. The processor 37 then examines S117 the list 45 of box identifiers 10 in the memory 35 to determine whether the box identifier 10 received is on the list 45. If not, then an error code is generated S119. If the box identifier is on the list 45, then the received device identifier 31 is compared S121 with the list of device identifiers 31 registered for that box identifier 10. If the device identifier 31 is registered to the box identifier then the server 27 computes an access code S123.

If the device identifier 31 is not registered to the box identifier 10, then the processor 37 determines S125 whether the device identifier 31 is in the list 47 of device identifiers registered to delivery firms. If the device identifier 31 is registered in this list 47, then the server 27 generates an access code S129. If the device identifier is not registered in this list 47, then the server 27 generates S127 an error code.

The processes of generating an access code S123, S129 can be essentially the same as the process of generating access codes carried out in the box 1. Thus, to generate access codes, the code generator 41 applies an algorithm that has inputs including a current time value, as provided by the electronic timer 43 in the server 27 and a seed code related to the box identifier 10. The seed code is stored in the list 45 of box identifiers in the memory 35 of the server 27. Typically, this seed code is the same as that used in the corresponding box 1. Thus, the access codes generated at the server 27 can be made to be identical, or correspond with, those generated in the corresponding box 1 so long as the electronic timer 43 in the server 27 is approximately synchronised with the electronic timer 23 in the box 1.

Once generated, the access code or error code or codes will be transmitted to the user device 29 that made the access request. If an error code(s) is received, the user device 29 will display a message related to the error code(s) on a display of the user device 29. If an access code is received, then a message related to this access code can be displayed. Additionally or alternatively, in embodiments wherein the box 1 is provided with a wireless communications device, the user device 29 can be configured to transmit the access code to the box 1 via a wireless communications method mentioned above such as NFC, Bluetooth, IEEE 802.11 or the like.

In a further embodiment, the server 27 can be configured to refuse to send access codes to a user device 29 if that user device has transmitted multiple access request messages to the server within a predetermined time interval. Thus, for example, if three or more access request messages are received from a particular user device within a period of five minutes, then the server 27 can be configured to refuse to send further access codes to the user device 29 for a period of five minutes. Thus, in such embodiments, undesired multiple access attempts, for example as part of a fraudulent use of a user device, can be addressed in a manner that frustrates such fraudulent use.

In further embodiments, the server 27 can be configured to refuse to send access codes to a user device 29 on the basis of the time or day that the request is made. Thus, for example, if a request for an access code is made by a user device 29 that is registered as belonging to a delivery firm, then the server 27 can be configured to refuse to provide an access code if the request is received during a period when deliveries will not be made. This could be, for example, between the hours of midnight and 6 am and/or on a Sunday. The skilled person will recognise that other rules for the provision of access codes based on the request time and/or date can also be implemented.

The skilled person will recognise that the process of synchronising electronic timers and assignment of seed codes can be accomplished during manufacture or during commissioning of the box, and how this can be achieved. Accordingly, the process will not be described in detail here.

Figure 9:
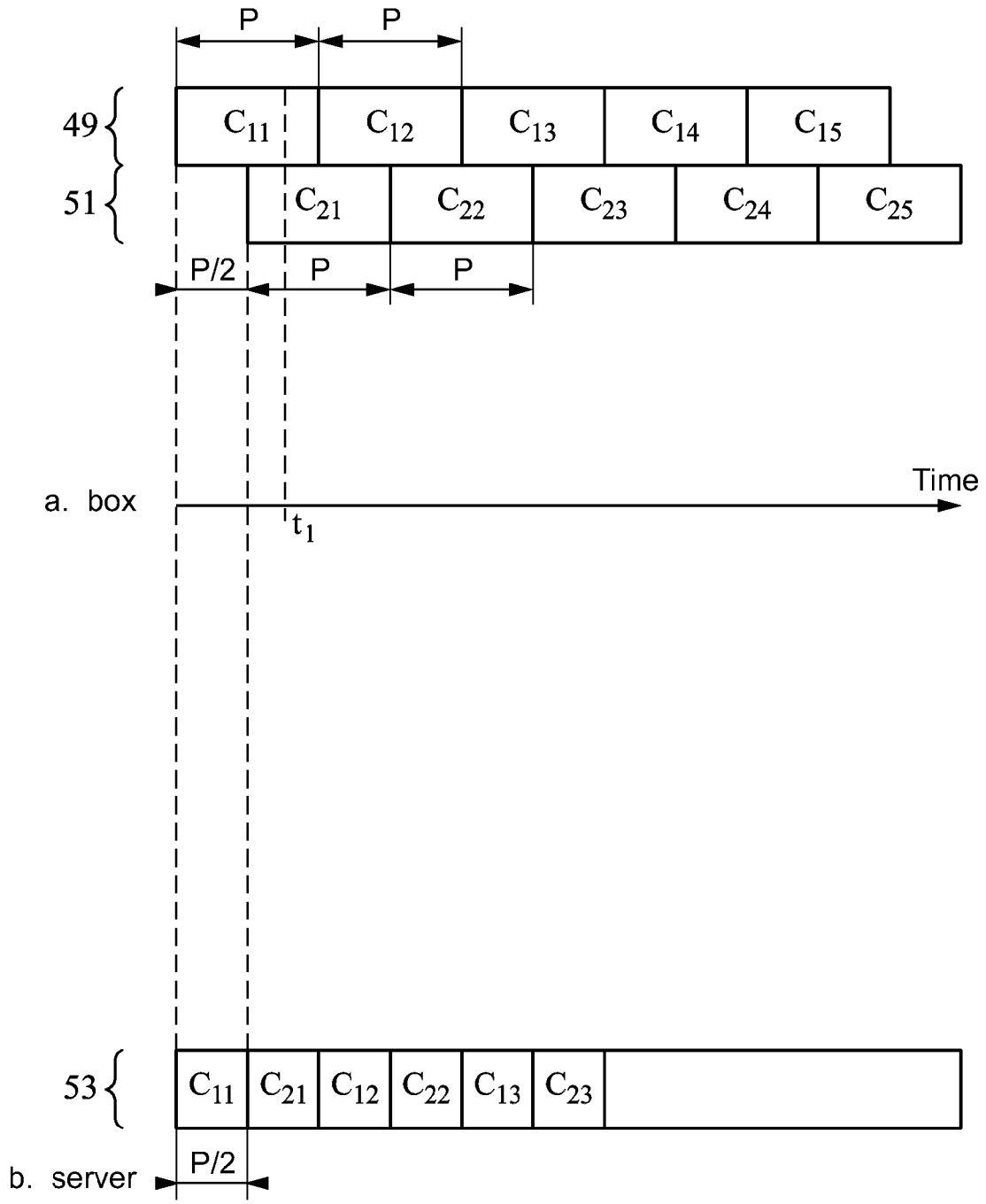
FIG. 9 illustrates details of a method of synchronisation of electronic timers according to embodiments.

However, the skilled person will also recognise that the electronic timer 23 in a box 1 can gradually lose synchronisation with that 43 provided in a server 27. Since the valid period of a code can be of the order of minutes, this loss of synchronisation will tend to happen over a relatively long period. However, if the electronic timers 23, 43 do become unsynchronised to the extent that the access codes no longer match, then access to the box 1 will become impossible. With this in mind, in a further embodiment, the lock 5 of the box 1 is configured to concurrently generate two sets of access codes. With reference to FIG. 9*a*, each access code in each set of access codes 49, 51 is valid for a time period of duration P, and the validity periods of the two sets of access codes 49, 51 are different. Thus, in the example shown in FIG. 9, a first access code $C_{11}$ in the first set of access codes 49 is valid for a period P, which can be, for example, 2 minutes. However, the skilled person will recognise that other validity periods could equally be used. At the end of the validity period for this access code $C_{11}$, this access code ceases to be valid, and the subsequent access code $C_{12}$ in this first set 49 becomes valid. Similarly, the second set of access codes 51 is configured in the same manner. Thus at the end of a period of validity of a first code $C_{21}$ in the second set 51, a second code $C_{22}$ in the second set becomes valid in place of the first code $C_{21}$.

However, the validity periods for the two sets 49, 51 are staggered by a period of P/2. Thus half-way through the valid-period of the first access code $C_{11}$ in the first set 49, the first access code $C_{21}$ in the second set 51 of access codes also becomes valid. This access code $C_{21}$ also has a valid period of P, and so there is a period P/2 during which both the code $C_{11}$ in the first set 49 is valid and the code $C_{21}$ in the second set 51 are valid. Moreover, each access code in each set has a period of P/2 in which first access code in the other set is also valid and a period of P/2 in which a second access code in the other set is also valid. Thus, to gain access to the box 1 at a given time $t_1$, either an access code $C_{11}$ in the first set 49 can be input or an access code $C_{21}$ in the second set 51 can be input.

With reference to FIG. 9*b*, the remote server 27 is configured to provide access codes 53 that vary with a period of P/2 and that alternate between a code from the first set 49 as generated by the box 1 and then one from the second set 51 as generated by the box 1. Thus, a code request at a given time would result in access code $C_{11}$ being provided, whist a request at a time P/2 later would result in access code $C_{21}$ being provided. The subsequent order of access codes would be $C_{12}$, $C_{22}$, $C_{13}$, $C_{23}$ and so forth.

Thus, if the electronic timer 23 at the box 1 and that 43 at the server 27 are perfectly synchronised (ignoring the time taken between code generation and code input), then during the first half of the period in which particular code $C_{1x}$ from the first set of codes 49 is valid at the box 1, the box 1 will tend to receive $C_{1x}$. Similarly, during the second half of the period at which $C_{1x}$ is valid at the box 1, the box 1 will tend to receive code $C_{2x}$.

Figure 10:
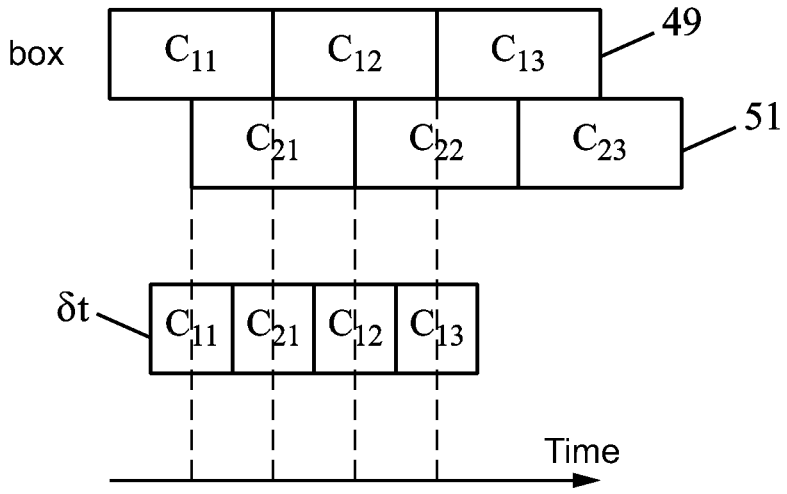
FIG. 10 illustrates further details of the method of FIG. 9.

FIG. 10 illustrates the situation if the electronic timer 43 in the server 27 is a time δt behind that of the electronic timer 23 in the box 1. As is clear from the Figure, in such a situation, the box 1 will tend to receive code $C_{1x}$ during a period δ of the second half of the period when code $C_{1x}$ is valid at the box 1, and also during the period (P/2−δt) of the first half of the period when the code $C_{1x}$ is valid at the box 1.

The skilled person will recognise that, if the box 1 tends to receive, over a number of access attempts, access code $C_{1x}$ during the second half of the period during which this access code is valid at the box 1, then it can be inferred that the time registered in the electronic timer 43 in the server 27 is behind that of the electronic timer 23 in the box 1. Conversely, if the box 1 tends to receive access code $C_{2x}$ during the first half of the period during which this access code is valid at the box 1, then it can be inferred that the time registered in the electronic timer 43 in the server 27 is ahead of that of the electronic timer 23 in the box 1.

Accordingly, in this embodiment, the processor 25 in the lock 5 of the box 1 is further configured to assess whether the time registered in the electronic timer 23 should be adjusted and, if necessary, adjust the electronic timer 23 accordingly. This assessment can be on the basis of the input time of a plurality of valid input codes relative to their respective periods of validity. Thus, a statistical treatment of the input time and/or the adjustment to the electronic timer 23 can be used.

Moreover, by judging the point in the second half of the period during which a received code is valid at the box 1, information regarding the magnitude of the discrepancy between the times registered in the electronic timers 23, 43 can be estimated. The skilled person will recognise that some degree of discrepancy between the electronic timers 23, 43 is desired since it will take a finite amount of time to transmit an access code from the server 27 to a user device 29 and subsequently input the access code into the box 1. However, this discrepancy can effectively be ignored in this analysis, since the optimum synchronisation between the electronic timers 23, 43 can be defined to be related to when access codes are actually input to the box 1. By synchronising using the times that access codes are actually input into the box 1, the relative timing of the electronic timers 23, 43 will tend to this optimum synchronisation.

However, the skilled person will recognise that the means by which an access code is input into the box 1 will have an effect on the perceived state of synchronisation. This is because, in general, it will take a longer period of time for a user to input an access code manually than it would for such an access code to be transmitted by wireless means. Thus, in embodiments wherein input of access codes can be effected by two or more means, the means of input is stored in a memory of the controller 17 together with data relating to the fraction of the validity period that has elapsed when the access code was input into the box 1. Thus, due account can be made of the time taken to input the code. This can be made by, for example, assuming that manual input of an access code takes 10 seconds from generation to input, while wireless input of an access code takes 2 seconds. The skilled person will recognise that these time periods for access code input are merely examples an other assumed periods can also be employed.

Thus, to perform adjustment of the electronic timer 23 of the box 1, a memory associated with the controller 17 stores data with details of the fraction of the validity period that has elapsed when each access code is input into the box 1, and possibly also details of the means by which the access code was input (manually or by wireless communication means). This data is maintained for a number of access code inputs so that a statistical treatment of the input time relative to the validity period can be made. Subsequently after a number of code inputs, in this embodiment 10, the controller 17 determines whether an adjustment to the electronic timer need be made. An adjustment is deemed necessary if, on average, an access code is input within the last 25% of the validity period. The applied adjustment is a fraction of the difference between the centre of the validity period and the average code input time relative to the validity period.

The skilled person will recognise that different algorithms, such as using a number of code inputs other than 10, can equally be employed without departing from the scope of the invention.

In further embodiments higher numbers of valid access codes can be employed. Thus, for example, three sets access codes can be calculated for the box 1. Each of these sets can have a valid period that either overlaps that of the other sets by one third of the valid period for any given access code, or that is staggered by half of the access code validity period. Thus, in such embodiments, the accuracy of information related to any time offset between the electronic timers 23, 43 can be improved and so an improved synchronisation can be achieved.

In such an embodiment employing three sets access codes, wherein a first set of access codes has a validity period that is staggered by one third of the validity period with respect to a second set and a third set of access codes has a validity period that is staggered by a further one third of the validity period with respect to the second set, synchronisation between the electronic timers can be determined as follows:

In this embodiment, the lock 5 of the box 1 is configured to concurrently generate three sets of access codes. Each access code in each set of access codes 49, 51, 52 is valid for a time period of duration P, and the validity periods of the three sets of access codes 49, 51, 52 are different. Thus, in the example, a first access code $C_{11}$ in the first set of access codes 49 is valid for a period P, which can be, for example, 2 minutes. However, the skilled person will recognise that other validity periods could equally be used. At the end of the validity period for this access code $C_{11}$, this access code ceases to be valid, and the subsequent access code $C_{12}$ in this first set 49 becomes valid. Similarly, the second and third sets of access codes 51, 52 are configured in the same manner. Thus at the end of a period of validity of a first code $C_{21}$ in the second set 51, a second code $C_{22}$ in the second set becomes valid in place of the first code $C_{21}$ and at the end of a period of validity of a first code $C_{31}$ in the third set 52, a second code $C_{32}$ in the third set becomes valid in place of the first code $C_{31}$ However, the validity periods for the three sets 49, 51, 52 are staggered by a period of P/3. Thus one third of the way through the valid-period of the first access code $C_{11}$ in the first set 49, the first access code $C_{21}$ in the second set 51 of access codes also becomes valid. This access code $C_{21}$ also has a valid period of P, and so there is a period 2P/3 during which both the code $C_{11}$ in the first set 49 is valid and the code $C_{21}$ in the second set 51 are valid. Two-thirds of the way through the valid-period of the first access code $C_{11}$ in the first set 49, the first access code $C_{31}$ in the third set 52 of access codes also becomes valid. This access code $C_{31}$ also has a valid period of P, and so there is a period P/3 during which both the code $C_{11}$ in the first set 49 is valid and the code $C_{31}$ in the third set 52 are valid. During this period, the first code $C_{21}$ in the second set 51 is also valid.

Moreover, at any particular time three access codes, one from each set 49, 51, 52 will be valid. Thus, to gain access to the box 1 at a given time $t_1$, an access code $C_{11}$ in the first set 49 can be input, an access code $C_{21}$ in the second set 51 can be input or an access code $C_{31}$ in the third set 52 can be input.

The remote server 27 is configured to provide access codes 53 that vary with a period of P/3 and that cycle between a code from the first set 49 as generated by the box 1 and then one from the second set 51 as generated by the box 1, then one from the third set 52 as generated by the box 1, and subsequently back to a code from the first set 49. Thus, a code request at a given time would result in access code $C_{11}$ being provided, whist a request at a time P/3 later would result in access code $C_{21}$ being provided and at a time a further P/3 later would result in access code $C_{31}$ being provided. The subsequent order of access codes would be $C_{12}$, $C_{22}$, $C_{32}$, $C_{13}$, $C_{23}$, $C_{33}$ and so forth.

In this embodiment, the electronic timer 43 in the server 27 is initially synchronised such that each access code will be provided by the server 27 at a time corresponding to the centre third if the validity period of that access code at the box 1. As with other embodiments, the input method e.g. manual or via wireless means, of the access codes can be taken into account during the synchronisation process.

Taking the arbitrary time $t_1$ as a time at which an access code is input to the box 1, this happens to occur during the centre third of the validity period of a code in the second set 51 ($C_{21}$). If an access code ($C_{11}$) from the first set 49 is received, and is valid at the time of reception, then the time stored in the electronic timer 23 of the box 1 is deemed to be in advance of that stored in the electronic timer 43 of the server 27. Conversely, if an access code ($C_{31}$) from the third set 52 is received, and is valid at the time of reception, then the time stored in the electronic timer 23 of the box 1 is deemed to be behind that stored in the electronic timer 43 of the server 27. If an access code ($C_{21}$) from the second set 51 is received, and is valid at the time of reception, then the time stored in the electronic timer 23 of the box 1 is deemed to be consistent with that stored in the electronic timer 43 of the server 27.

As a further example, taking the arbitrary time $t_2$ as a time at which an access code is input to the box 1 this happens to occur during the centre third of the validity period of a code in the third set 52 ($C_{32}$). If an access code ($C_{22}$) from the second set 51 is received, and is valid at the time of reception, then the time stored in the electronic timer 23 of the box 1 is deemed to be in advance of that stored in the electronic timer 43 of the server 27. Conversely, if an access code ($C_{13}$) from the first set 49 is received, and is valid at the time of reception, then the time stored in the electronic timer 23 of the box 1 is deemed to be behind that stored in the electronic timer 43 of the server 27. If an access code ($C_{32}$) from the third set 52 is received, and is valid at the time of reception, then the time stored in the electronic timer 23 of the box 1 is deemed to be consistent with that stored in the electronic timer 43 of the server 27.

In general, the box 1 will expect any particular access code to be input during the centre-third of its validity period. If, instead, it receives an access code during the final third of its validity period then the then the time stored in the electronic timer 23 of the box 1 is deemed to be in advance of that stored in the electronic timer 43 of the server 27. Conversely, if the box 1 receives a code during the first third of its validity period then the then the time stored in the electronic timer 23 of the box 1 is deemed to be behind that stored in the electronic timer 43 of the server 27.

As with the embodiments in which two sets of codes are employed for resynchronisation purposes, a statistical treatment of the input time of several access codes relative to their validity periods at the box 1 can be used. Thus, an adjustment to the time of the timer 23 in the box 1 can be made after, for example, 10 access codes have been input, and the adjustment based on an average of the input time relative to the validity periods of the receved codes, taking into account the input method(s) used to input the access codes.

In alternative embodiments, the server 27 takes account of the variable delay between issue of an access code and subsequent input of the access code into a box 1 caused by the method of input of the access code. Thus, for example, if the server 27 determines that an access code will be input to a box 1 by manual input via a keypad, then the server 27 can temporarily adjust the time registered by its electronic timer 43 to take account of the delay. Thus, in such a circumstances the time registered by the electronic timer 43 in the server 27 can be adjusted to be some time later than the true time (e.g. 10 seconds) to remove any effective de-synchronisation between the electronic timer 23 in the box 1 and that 43 in the server 27. The skilled person will recognise that a different (smaller) delay, or no effective delay can be assumed in the event that an access code is input by wireless communication means.

In such embodiments, the server 27 can determine the method by which an access code is likely to be input from knowledge of the box 1 and the user device 29 that made the access request related to the box 1. Therefore, in such embodiments, the LUTs 45, 47 stored in the memory 35 of the server 27 will further comprise information as to whether the box 1 and/or the user device 29 support wireless communications. Information regarding the type of wireless communications supported by the box 1 and the user device 29 can also be stored. If both the box 1 and the user device 29 support a compatible type of wireless communications, e.g. both support NFC, then it can be assumed by the server 27 that an access code will be input by such means. Conversely, if one or both do not support wireless communications, or both support wireless communications but in a form that is not mutually compatible, then the server 27 can assume that the access code will be input by manual means. Based on this determination, a temporary adjustment to the electronic timer 42 in the server 27 can be applied before calculating the access code, if such a delay is required by the assumed input method as described above.

In alternative embodiments, synchronisation of the electronic timers 23, 43 in the box 1 and/or the server 27 can be achieved using an externally provided clock signal, such as the DCF77 time signal or signals from satellites such as GPS satellites. Thus, in such embodiments the box 1 and server 27 will further comprise receivers for such time signals and means to synchronise (with any necessary offset) the electronic timers 23, 43 with the received time signals.

In further alternative embodiments, synchronisation of the electronic timers 23, 43 in the box 1 and/or the server 27 can be achieved using externally provided timing information that is transmitted to the box 1 from a user device 29 by wireless methods, such as near field communications (NFC), Bluetooth, IEEE 802.11 or the like. In such embodiments, each time a user device 29 undergoes a dialog with the box 1 via such wireless means, a request is generated by the user device 29 for both the local time of the box 1 (as registered in the electronic timer 23) and the corresponding local time in the electronic timer 43 of the server 27. If responses are received from both the server 27 and the box 1 within a predetermined time interval, for example 2 seconds, then a comparison of the times is made on the user device 29. The difference in times (if any) is sent by the user device 29 to the server 27 in the form of a message. The server 27 then stores a record of the discrepancies and, in the event that a discrepancy is deemed unacceptable, for example if it exceeds a predetermined fraction of the validity period of an access code, a correction can be ordered by the server 27. The correction can take the form of a message transmitted from the server 27 to the user device 29 and on to the box 1 to correct the time in the electronic timer 23 of the box 1 by a certain amount, defined in the message.

In any of the above described embodiments, an owner of the box 1 can be informed of when the box 1 has been accessed, or indeed of whether a disallowed access attempt has been made. Thus, for example, in the event that an access code or an error code/message has been sent by the server 27 in response to a received access request, the server 27 can be configured to send a message to the owner of the box 1 indicating that the event has occurred. The message can include information regarding the event and/or of the user device making the request. The message can be sent, for example to a preregistered email address stored in association with the box identifier 10 in the memory 35 of the server 27. Alternatively, or additionally, a message can be sent to the user device 29 that is registered as belonging to the owner of the box 1. Thus, in such embodiments, the owner of the box 1 can have information of when deliveries or collections have been made and by whom, and/or of who made unsuccessful access requests.

In further embodiments, the probable status of the box 1 can be derived by analysis of historic access requests. Thus, for example, if the last access request received (that resulted in an access code being transmitted by the server 27) was an access request by a user identifier 31 registered to a delivery firm, then the probable status of the box 1 can be determined to be "full" or "partially full". In such circumstances, the server 27 can be configured to not transmit a further access code in response to a request from a user device 29 that is registered as belonging to a delivery firm if the box status is "full". Rather, the server 27 can be configured to transmit an error message informing the user of the requesting user device 29 that the box 1 is full. In this embodiment, the status of the box 1 can subsequently be estimated as "empty" if the last access request received (that resulted in an access code being transmitted by the server 27) was an access request by a user identifier 31 registered to the owner of the box 1. To implement the method of this embodiment, the method described in relation to FIG. 8 will have an extra step between step S125 and step S129. Thus, if the received device identifier 31 is in the stored list 47 of devices registered to a delivery firm, then the processor 37 will check whether the current status of the box 1 is "full". If the status of the box 1 is "full", then an error code is transmitted, otherwise the method continues to step S129 and an access code is transmitted.

The skilled person will recognise that, by defining a box status as "partially full" after receipt of a first package, this embodiment can be extended to, for example, allow two or more access requests from user devices 29 registered to one or more delivery firms to result in access codes being transmitted by the server 27 without an intervening transmission of an access code to the owner of the box 1. Thus, under such an embodiment, it can be assumed that two or more packages can be delivered to the box 1 before the status is assumed to be "full".

In further embodiments, the box 1 can comprise a plurality of separate sections which are accessible to different users. Thus, a plurality of door panels are provided, with each door panel giving access to a different section. Each door panel has a separate lock, which will have a particular access code for any given time period, while the box can have a single box identifier 10. The locks can all be controlled by a single processor 25. Access to the different sections can be controlled on the basis of the user identifier 31 of the user making the request. Thus, for example if an access request is received from a user device 29 having a user identifier 31 that is registered as belonging to a delivery firm, then an access code for opening a first section of the box 1 can be provided, for example for delivery of a package. In contrast, if an access request is received from a user device 29 that is registered to a third party, such as for example a cleaner for the property at which the box is located, then an access code for opening a second section of the box 1 can be provided. This second section can, for example, be used to store a mechanical key to the property at which the box is located. Additionally, if an access request is received from a user device 29 that is registered to an owner of the box 1, then an access code for opening all sections of the box 1 can be provided. The skilled person will recognise that this embodiment provides the advantage that a box 1 can be configured to allow controlled access to the contents of the box to particular individuals in a manner that can be controlled remotely.

Figure 11:
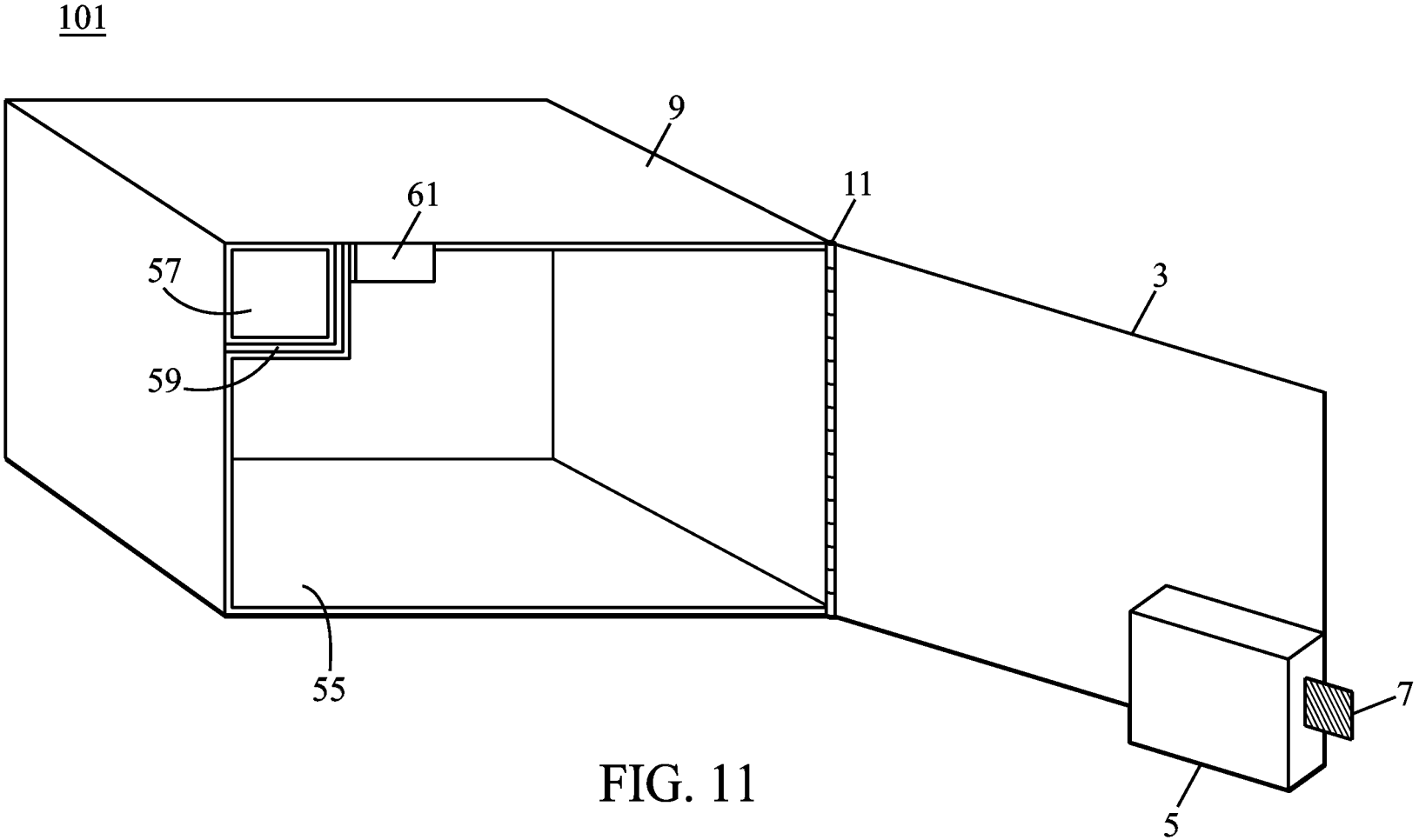
FIG. 11 illustrates a box according to further embodiments.

A further embodiment, compatible with any of the previously described embodiments, provides an alternative to the previous embodiment. In this further embodiment the box again comprises a plurality of separate sections, which are accessible to different users. FIG. 11 illustrates an example of such a box 101, wherein features that are essentially the same as those in the box 1 described in relation to FIGS. 1-4 are given the same reference numerals. As can be seen from FIG. 11, the box 101 of this embodiment can comprise all of the features of the box 1 described in relation to FIGS. 1-4. In addition, the box 101 further comprises a second section 59 that is configured to be assessable by a second door panel 57, which is also hinged. This second door panel has a second electronic lock and actuator (not shown) associated with it that is also controlled by the processor 25 of the lock 5. When the first door panel 3 is closed, the second door panel 57 is located behind it. Thus, access to the second door panel 57 is only possible once the first door panel 3 is opened. Also illustrated in FIG. 11, is a third door panel 55, which is also hinged. As with the second door panel 57, this is located behind the first door panel 3 when the first door panel 3 is closed. The third door panel 55 also has an associated electronic lock and actuator (not shown) that is also controlled by the processor 25 of the lock 5. The electronic locks for the second 57 and third 55 door panels are linked to the electronic lock of the first door panel by electrical means, such as wires to provide the requisite control from the first electronic lock 5. The processor 25 is configured to be able to control the electronic locks independently of one another.

The third door panel 55 is at least partially transmissive to optical radiation. Thus, the third door panel 55 can for example be constructed from glass, Perspex, a planar material with one or more holes or a mesh, such as wire mesh. Thus, when the first door panel 3 is open but the third door panel 55 is closed, the contents of the box 101 behind the third door panel 55 can be viewed. Located in the box is a display 61, and this is position such that, when the third door panel 55 is closed, the display 61 is behind the third door panel 55. Moreover, since the third door panel 55 is somewhat transmissive, the display 61 can be through the third door panel 55 when the third door panel 55 is closed. The display 61 is configured to display information related to the delivery of a package as will be described below in relation to FIG. 12.

In use, and as with the previously described embodiment, access to the different sections can be controlled on the basis of the user identifier 31 of the user making the request. Thus, for example if an access request is received from a user device 29 having a user identifier 31 that is registered as belonging to a delivery firm, then an access code for opening a first door panel 3 and the third door panel 55 of the box 101 will be provided. Thus, this can be used for delivery of a package. In contrast, if an access request is received from a user device 29 that is registered to a third party, such as for example a cleaner for the property at which the box is located, then an access code for opening the first door panel 3 and the second door panel 57 will be provided. Additionally, if an access request is received from a user device 29 that is registered to an owner of the box 1, then an access code for opening all door panels 3, 55, 57 of the box 101 can be provided.

Figure 12:
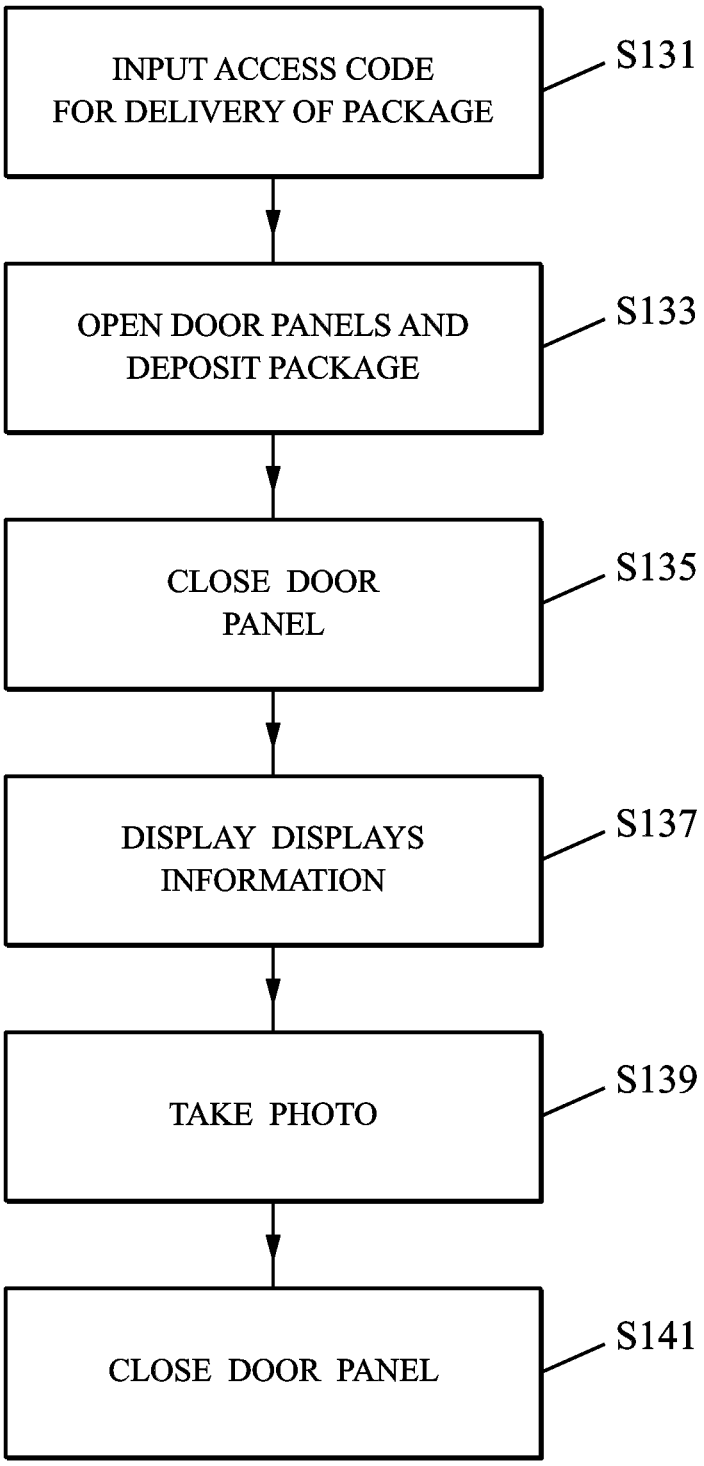
FIG. 12 illustrates steps in a method of proving delivery of a package according to embodiments.

The box 101 of the presently described embodiment can also be used to perform a method wherein proof of delivery of a package can be made, such as with a "signed-for" or recorded delivery, this method is now described with reference to FIG. 12.

To enact this method, access to the package delivery section of the box 101, by obtaining an access code to open the first 3 and third 55 door panels is first made as described above. The user (in this case a delivery person) then inputs the received access code into the box 101, S131. After opening the first 3 and third 55 door panels, the package is deposited in the box 101 S133. After placing the package in the box 101, the third door panel 55 is closed S135, and it is configured to lock automatically. The closing of the third door panel 55 also triggers the display 61 to display information related to the delivery S137. In the presently described embodiment, the information is the time of the delivery.

However, the skilled person will recognise that other pieces of information can also be displayed, such as merely an indication that the third door panel 55 is closed, a code for providing encoded information related to the delivery, or a measure of the weight of the package inside the box 101. For the purposes of measuring the weight of a package, an electronic balance can be provided in the box 101.

The user then takes a photograph (image) of the delivered package and the display 61 as seen from behind the third door panel 55. This image serves to act as proof that the package was delivered and the information displayed gives proof of the time at which it was delivered. The user then closes the first door panel 3 S141 to complete the delivery.

The image acquired in step S139 can either simply be retained by the user, or can be sent to the server 27, the owner of the box 101 or the delivery firm. Thus, for example, the user can acquire the image using a camera that is included in the user device 29 and send it either directly to a user device 29 of the owner, or indirectly by firstly sending the photo to the remote server 27 which then forwards the image, possibly including a message to the user device 29 of the owner of the box 101.

In all of the above described embodiments, different sets of access codes will be required to deal with situations in which the behaviour of the box 1, 101 must be different depending on the user, or if the box comprises more than one section. To generate the multiple sets of access codes, the code generators 21, 41 in the box 1, 101 and server 27 respectively can either employ multiple seed codes, or multiple code generation methods using a single seed code. Thus, in embodiments where there are three user types, three seed codes can be stored in each of the server 27 and the box 1, 101. The box 1, 101 will be configured to register access codes from each of the seed codes as valid for any given time as previously described. The server 27 will be configured to generate an access code that is relevant to the user type in question as determined from the user identifier received in the access request message.

In alternative embodiments where there are three user types, three code generation algorithms can be stored in each of the server 27 and the box 1, 101. Each of the code generation algorithms is capable of generating a different access code at any given time using the same seed code. The box 1, 101 will be configured to register access codes from each of the code generation algorithms as valid for any given time as previously described. The server 27 will be configured to generate an access code that is relevant to the user type in question as determined from the user identifier received in the access request message.

In further embodiments, a plurality of boxes 1, 101 can be placed together to form a locker station, for example at a public place such as a railway station, airport, town hall, shopping centre or post office. In such embodiments, the plurality of boxes 1, 101 will share a common input means for access codes, such as a keypad 13 or wireless input means. A delivery person will, on arrival at the locker station, request an access code from the remote server 27 by any of the means described in relation to previous embodiments except that the identifier 10 of the box 1, 101 will not form a part of the access request. Rather, an identifier of a user will be substituted for the identifier 10 of the box 1, 101. In such embodiments, the user identifier will relate to a previously registered user of the delivery service. Thus, a request will be deemed valid if both the user identifier and the identifier of the user device 29 of the delivery person are both registered with the delivery service.

The remote server 27 stores in its memory 35 details of the status of each box 1, 101 in the locker station. Thus, on receipt of a valid request for an access code, the remote server 27 will provide an access code for an empty box 1, 101. The delivery person can then access the box 1, 101 via any of the methods previously described and subsequently deposit the delivery.

The remote server 27 then sends a delivery message, via any of the messaging means previously disclosed, to the user device 29 corresponding to the user identifier contained within the access request. The delivery message sent contains information regarding the delivery, such as the location of the locker station and/or the time of delivery, and also a further identifier. The further identifier contains information suitable to identify the package delivered, and information corresponding to this further identifier is also stored in the memory 35 of the remote server 27.

To collect the package the user will, on arrival at the locker station, send an access request to the remote server 27 using their user device 29. The access request will comprise the further identifier and the identifier of the user device 29. The remote server 27 then validates this request using the validation methods previously described and, if the request is vlaid provides an access code. The access code is determined on the basis of the time and the identity of the box 1, 101 that contains the package. The identity of the box 1, 101 that contains the package is in turn determined by examination of the memory 35 of the remoter server 27 by the remote server 27 to see which box identifier 10 relates to the package in question.

In all of the above described embodiments, the methods of generating access codes for opening the locks 5 in both the server 27 and the lock 5 can further include a step by which it is ensured that an immediately subsequent access code is different from a previously generated access code. This step can take the form of a simple comparison such as a subtraction of the proposed subsequent access code from the previous access code. So long as the result of the subtraction is not zero, then the proposed subsequent access code is considered acceptable. If the result of the subtraction is zero, then an alternative access code must be generated in place of the proposed access code. The alternative access code can be generated by adding a predetermined value to the proposed access code. Thus, for example 1 (or some other integer) can be added to the proposed access code to yield the alternative access code. Alternatively, a replacement code can be calculated by temporarily changing the seed code of code generation algorithm.

Both the processor in the processor 37 in the server 27 and the processor 25 in the lock 5 must be configured to change the access code in the same predetermined manner.

In all of the above described embodiments in which a plurality of access codes are valid at a particular time, it is necessary that each of the currently valid access codes are different so that a correct unlocking behaviour, or synchronisation correction, can be ensured. In a manner similar to that described above, each of the currently valid codes can be tested against one another to ensure that they are different. Thus, the methods of generating access codes for opening the locks 5 in both the server 27 and the lock 5 can further include a step wherein it is ensured that each proposed access code is different from every currently valid access code for a given validity period. This step can take the form of a simple comparison such as a subtraction of a proposed access code from the currently valid access codes. So long as the result of each subtraction is not zero, then the proposed access code is considered acceptable. If the result of any subtraction is zero, then an alternative access code must be generated in place of that proposed access code. A further check must then be made to ensure that the replacement proposed access code is also not the same as any currently valid access code.

In a similar manner to that described above, the alternative access code can be generated by adding a predetermined value to the proposed access code. Alternatively, a replacement code can be calculated by temporarily changing the seed code of code generation algorithm. Thus, for example 1 can be added to the proposed access code to yield the alternative access code. Both the processor in the processor 37 in the server 27 and the processor 25 in the lock 5 must be configured to change the proposed access code in the same manner.

In further embodiments, proposed access codes can also be replaced even if they are only merely similar to a previous access code or a currently valid access code. Thus, for example, if a proposed access code differs by only one digit from an immediately previous access code or a currently valid access code, then it can be replaced by any of the methods described above.

In all of the above described embodiments, the processor 25 can be configured to record the fact that a particular access code has been input to the box 1, 101 and that access to the box 1, 101 has been gained as a result. In such embodiments, the processor 25 is configured to render a used access code no longer valid, even if the valid period for the access code has not expired. Thus, in such embodiments, multiple opening of the box 1 using a single code is prevented. This can be used, for example, to prevent removal of a package after delivery by inputting the same access code.

It is to be understood that combinations of the above described embodiments are also envisaged. Thus, where practical, any combination of the described embodiments is to be considered to be included as part of the disclosure of this application.

As mentioned above, embodiments can be embedded in a computer program product, which comprises all the features enabling the implementation of the methods described herein, and which—when loaded in an information processing system—is able to carry out these methods. Computer program means or computer program in the present context mean any expression, in any language, code or notation, of a set of instructions intended to cause a system having an information processing capability to perform a particular function either directly or after conversion to another language. Such a computer program can be stored on a computer or machine readable medium allowing data, instructions, messages or message packets, and other machine readable information to be read from the medium. The computer or machine readable medium may include non-volatile memory, such as ROM, Flash memory, Disk drive memory, CD-ROM, and other permanent storage. Additionally, a computer or machine readable medium may include, for example, volatile storage such as RAM, buffers, cache memory, and network circuits. Furthermore, the computer or machine readable medium may comprise computer or machine readable information in a transitory state medium such as a network link and/or a network interface, including a wired network or a wireless network, that allow a device to read such computer or machine readable information.

Expressions such as "comprise", "include", "incorporate", "contain", "is" and "have" are to be construed in a non-exclusive manner when interpreting the description and its associated claims, namely construed to allow for other items or components which are not explicitly defined also to be present. Reference to the singular is also to be construed in be a reference to the plural and vice versa.

While there has been illustrated and described what are presently considered to be the preferred embodiments of the present invention, it will be understood by those skilled in the art that various other modifications may be made, and equivalents may be substituted, without departing from the true scope of the present invention. Additionally, many modifications may be made to adapt a particular situation to the teachings of the present invention without departing from the central inventive concept described herein. Furthermore, an embodiment of the present invention may not include all of the features described above. Therefore, it is intended that the present invention not be limited to the particular embodiments disclosed, but that the invention include all embodiments falling within the scope of the invention as broadly defined above.

A person skilled in the art will readily appreciate that various parameters disclosed in the description may be modified and that various embodiments disclosed and/or claimed may be combined without departing from the scope of the invention.

The invention claimed is:

1. A locking device comprising:

a code generation means for generating a plurality of access codes in a first series and a second series, each access code having a period of validity, a plurality of code input means for receiving an input code, and a code comparison means comprising an electronic timer and means to compare a time at which an input code, that corresponds to a currently valid access code, is input with an elapsed fraction of the period of validity of the currently valid access code, wherein the code comparison means is configured to unlock the lock in response to input of a code that corresponds to a currently valid access code, wherein the period of validity of each access code in first series partially overlaps the period of validity of two adjacent access codes in the second series, and wherein the code generation means is further configured to adjust a current time of the electronic timer on the basis of both the elapsed fraction of the period of validity of the currently valid access code and also the code input means used to input the code.

2. A locking device according to claim 1, wherein the period of validity of each access code in each series is equal, and the overlap of the period of validity of each access code in each series is equal to half of the period of validity.

3. A locking device according to claim 1, wherein access codes are generated in a third series and the period of validity of each access code in the second series partially overlaps the period of validity of two adjacent access codes in the third series.

4. A locking device according to claim 1, wherein the plurality of code input means comprise a keypad and a wireless communications means.

5. A locking device according to claim 1, wherein the adjustment of the current time of the electronic timer acts to move the current time forward if the comparison reveals that a valid access code is input towards the end of its period of validity, and move the current time backward if the comparison reveals that a valid access is input towards the beginning of its period of validity.

6. A locking device according to claim 5, wherein the adjustment is made on a statistical basis by using the input time of a plurality of valid input codes with respect to their respective periods of validity.

7. A locking device according to claim 1, wherein a plurality of sets of series of access codes are generated concurrently, each of the sets of series of access codes being associated with a different class of user of the locking device.

8. A container for receiving deliveries comprising the locking device according to claim 1.

9. A method of operating a locking device, the method comprising:

generating a plurality of access codes in a first series and a second series, each access code having a period of validity, receiving an input code via one of a plurality of code input means, comparing a time at which an input code, that corresponds to a currently valid access code, is input with an elapsed fraction of the period of validity of the currently valid access code, unlocking the lock if the input code corresponds to the currently valid access code, and adjusting the current time of an electronic timer on the basis of both the elapsed fraction of the period of validity of the currently valid access code and also the code input means used to input the code, wherein the period of validity of each access code in the first series partially overlaps the period of validity of two adjacent access codes in the second series.

10. A computer program product comprising a non-transitory computer readable medium having computer readable instructions stored thereon which, when implemented on a processor perform all of the steps of the method of claim 9.

* * * * *